US007168919B2

(12) United States Patent
Blatchford et al.

(10) Patent No.: US 7,168,919 B2
(45) Date of Patent: Jan. 30, 2007

(54) TURBINE BLADE AND TURBINE ROTOR ASSEMBLY

(75) Inventors: David Paul Blatchford, Rugby Warwickshire (GB); Philip David Hemsley, Rugby Warwickshire (GB)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 11/247,756

(22) Filed: Oct. 11, 2005

(65) Prior Publication Data

US 2006/0257259 A1 Nov. 16, 2006

(30) Foreign Application Priority Data

Oct. 11, 2004 (GB) ..... 0422507.4

(51) Int. Cl.
*F04D 29/34* (2006.01)

(52) U.S. Cl. ..... 415/215; 415/248

(58) Field of Classification Search ..... 416/215, 416/216, 218, 219 R, 248
See application file for complete search history.

(56) References Cited

U.S. PATENT DOCUMENTS 3,834,831 A * 9/1974 Mitchell ..... 416/95

FOREIGN PATENT DOCUMENTS

JP 07063004 A * 3/1995
JP 2005220825 A * 8/2005

* cited by examiner

*Primary Examiner*—Edward K. Look
*Assistant Examiner*—Dwayne J White
(74) *Attorney, Agent, or Firm*—Darby & Darby

(57) ABSTRACT

A turbine blade has a shroud, a blade portion and a T-section root portion configured to lock into a T-section channel in a turbine rotor adjacent like blades in a ring. The blade portion is pre-twisted so that mutual alignment of the edges of the root and the shroud portion along the axis of the turbine in the final assembled condition provides a torsional bias which maintains the shroud in frictional contact with its neighbours to resist relative radial movement. The root portions have generally flat-sided surfaces occupying opposed substantially parallel radial planes of the T-section, but have circumferential abutments in the form of lands projecting from each side of the root portion at the same radius. When the circumferential abutments are radially aligned in the final assembled position, angular separation between adjacent blades is greater, by an amount related to the combined thickness of the abutments, than when the abutments are radially staggered.

30 Claims, 6 Drawing Sheets

TURBINE BLADE AND TURBINE ROTOR ASSEMBLY

Priority is claimed to United Kingdom Patent No. GB 04 22 507.4, filed on Oct. 11, 2004, the entire disclosure of which is incorporated by reference herein.

The present invention relates to a turbine blade, a turbine rotor assembly including such blades, and methods of assembly and disassembly of a turbine rotor assembly. It is particularly useful in the context of axial flow steam turbines that include one or more stages of the reaction type, but it is not limited to such application.

BACKGROUND

A conventional form of turbine rotor has a drum with a T-shaped channel for receiving the complementary T-shaped roots of a multiplicity of turbine blades. The other ends of the turbine blades are formed with integral shrouds which together form a shroud ring when assembled. Steam turbine moving blades require precision profiles that are most economically machined individually and then attached in rows to the turbine rotor.

Such T-shaped roots have parallelogram shapes which allow the "T" on the root to rotate into the rotor root slot or channel. To enable access of the last blade, a circumferential gap between each root is provided. This allows the blade roots to be closed up to create a larger gap for the last blade. The blade tip shrouds have no gaps. The access gap here is provided by the twisting of the blade, so that the parallelogram-shaped shroud rotates and becomes more circumferentially compact. After assembly of the last blade, the root gaps have to be filled with T-shaped shims, and the tips untwist until they become circumferentially in contact. The last few shims are in halves, and the last shim is held in place by a caulking material.

Thus existing configurations of T-shaped roots require the use of shims to secure them in place. The problem with this is that production costs are high, due partly to the need for skilled operatives and partly due to the complexity and cost of the shims themselves. The complexity of the shim shapes, causes them to be costly to produce in small numbers, and to require a high degree of assembly skill.

Other fastening types which can be used include a pinned root, or a side entry fir tree, but those these solutions required side access, and side access limits the steam path design and is more costly.

It is also possible to use a straddle root but this requires a window, i.e. a gap in the location ridge, to enable assembly. Any proposal that requires a window or a modified closing blade necessarily involves a weaker blade root at that point, and this limits the design of the whole blade ring, resulting in lower load carrying performance.

SUMMARY OF THE INVENTION

A purpose of the present invention is to overcome or at least mitigate the problems associated with previous blade root holding systems and configurations.

A first aspect of the invention provides a turbine assembly comprising a turbine rotor and a ring of turbine blades having blade portions, radially outer shroud portions and radially inner T-section root portions inserted into a corresponding T-section channel in the turbine rotor, the root portions comprising circumferential abutment means for abutment with corresponding abutment means on adjacent root portions, the blades being radially displaceable relative to each other after insertion into the channel such that in an initial assembled position the circumferential abutment means on adjacent root portions are radially staggered but in a final assembled position the circumferential abutment means are in radial alignment.

The above arrangement is intended to be used in an assembly wherein the blade portions are pre-twisted so that in the final assembled position radial alignment of the circumferential abutment means and the shroud portions provides a torsional bias which maintains the shroud in pressure and frictional contact with its neighbours to resist radial movement of the blades.

To provide additional radial location for the blades, the root portions may further comprise radial abutment means for abutment with radial abutment means in the channel of the turbine rotor when the root portions are in the final assembled position. Such radial abutment means may comprise radially inward-facing ledges on the root portions that latch against radially outward-facing ledges on the T-section channel and are preferably engaged with each other only during a final angularly small twisting or rotation of the blade root portion into its final assembled position within the channel in the rotor. As described later, to allow engagement and disengagement of the radial abutment means during assembly and disassembly of the turbine assembly, small gaps may conveniently remain between confronting circumferential abutment means when they are in the final assembled position.

Preferably, the circumferential abutment means comprises circumferentially projecting lands on opposed sides of the root portions. Each land may be of generally rectangular configuration and may extend over a full axial extent of the root portion.

According to a preferred embodiment of the invention, in the final assembled condition of the turbine assembly there are gaps between confronting faces of neighbouring root portions that are related to a combined thickness of the circumferential abutments of neighbouring root portions. In particular, the thicknesses of the circumferential abutments relative to the circumferential widths of the blades is such that a difference in angular separation between adjacent root portions in the initial and final assembly positions respectively is in the range 0.1 to 0.5 degrees of arc, preferably about 0.3 degrees of arc. Such gaps may be advantageous in that in a steam turbine they can improve turbine performance by enabling steam leakage flow to pass through the blade roots between the high and low pressure side of the blade ring without interfering with flow through the main turbine steam flow path, so providing an alternative to the use of steam balance holes.

In a related aspect of the invention, a turbine assembly comprises a turbine rotor and a ring of turbine blades having blade portions, radially outer shroud portions and radially inner T-section root portions inserted into a corresponding T-section channel in the turbine rotor, the root portions having radial abutment means for abutment with radial abutment means in the channel of the turbine rotor when the root portions are in a final assembled position within the channel in the rotor, the radial abutment means on the root portion and the channel being dimensioned to engage with each other only during a final angularly small rotation of the blade root portion into the final assembled position. For example, the radial abutment means on the root portion may be dimensioned to engage with the abutment means on the channel only during a final two degrees of rotation of the blade root portion into the final assembled position.

The invention also includes a turbine rotor blade configured for use in turbine assemblies as described above.

Furthermore, the present invention provides a turbine blade having a shroud, a blade portion and a T-section root portion configured to lock into a T-section channel in a turbine rotor adjacent like blades in a ring, the shroud being part-annular and configured with generally the same angle of arc as the root, but the blade portions being pre-twisted so that mutual alignment of the edges of the root and the shroud portion along the axis of the turbine in a final assembled position provides a torsional bias which maintains the shroud in pressure and frictional contact with its neighbours to resist relative radial movement; the surfaces of the root portion being generally flat in two substantially parallel radial planes of the T-section, but having circumferential abutment means projecting from each of those flat surfaces at the same radius, such that an angular separation between adjacent like blades is greater, by an amount related to the combined thickness of the abutment means, when the abutment means are radially aligned in the final assembled position than when the abutment means are radially staggered.

Further, the invention provides a turbine rotor assembly comprising a rotor and a multiplicity of blades as described above, in which the assembly is held in place while non-rotating by a net radial force produced by the contact forces between abutting shroud portions of adjacent blades resolved onto a radial line through the centre of the blade, and by friction between edges of the shrouds, the shrouds together forming a shroud ring, the circumferential abutments of adjacent rotor roots being radially aligned, and the root portions being locked into the T-shaped channel in the rotor.

The invention also provides a method of assembling a turbine rotor assembly constructed as described above, comprising the steps of: (a) inserting and twisting all but one of the blades into engagement of their root portions in the rotor drum channel, but with alternate root portions staggered radially such that none of the circumferential abutment means are radially aligned and a gap remains into which the last blade root portion can be inserted, the gap being of greater circumferential extent than the last blade root portion; (b) twisting the last blade into place in the gap to leave a residual gap adjacent the last blade; and (c) lifting alternate blades radially outward to radially align the circumferential abutment means and substantially close the residual gap.

In the case where additional radial location is provided in the form of radial abutments between the blade root portion and the channel in the rotor, the assembly method includes a further step after step (c) above, in which the blades are further twisted though a small angle into the final assembled position to engage the radial abutment means on the root portion with the radial abutment means on the channel in the rotor.

The invention also provides a method of disassembling a turbine rotor assembly constructed as described above, comprising the steps of: (a) pushing alternate blades radially inward so as to radially stagger them so that the circumferential abutment means are no longer in radial alignment; (b) arranging the blades so as to provide a gap around one of the blades; (c) twisting the said one blade and removing it radially from the assembly; and (d) successively removing further blades.

Again, in the case where additional radial location is provided in the form of radial abutments between the blade root portion and the channel in the rotor, the disassembly method includes performance of the following steps before step (a): (i) selecting a first blade for removal; (ii) pushing all the blades in the rotor hard together to close up the small gaps between confronting circumferential abutment means of neighbouring blades, thereby to create a circumferential clearance between the selected first blade and a neighbouring blade; (iii) twisting the selected first blade by a small amount to unlatch the radial abutments on the blade root portion from the radial abutments on the channel in the rotor; and (iv) pushing the selected first blade radially inward; the method further comprising an additional step before each alternate blade is pushed radially inwards, the additional step comprising twisting each said alternate blade by a small amount to unlatch the radial abutments on the blade root portion from the radial abutments on the channel in the rotor.

BRIEF DESCRIPTION OF THE DRAWINGS

In order that the invention may be better understood, preferred embodiments will now be described, by way of example only, with reference to the accompanying drawings, in which.

DETAILED DESCRIPTION OF THE PREFERRED EMBODIMENTS

Figure 1:
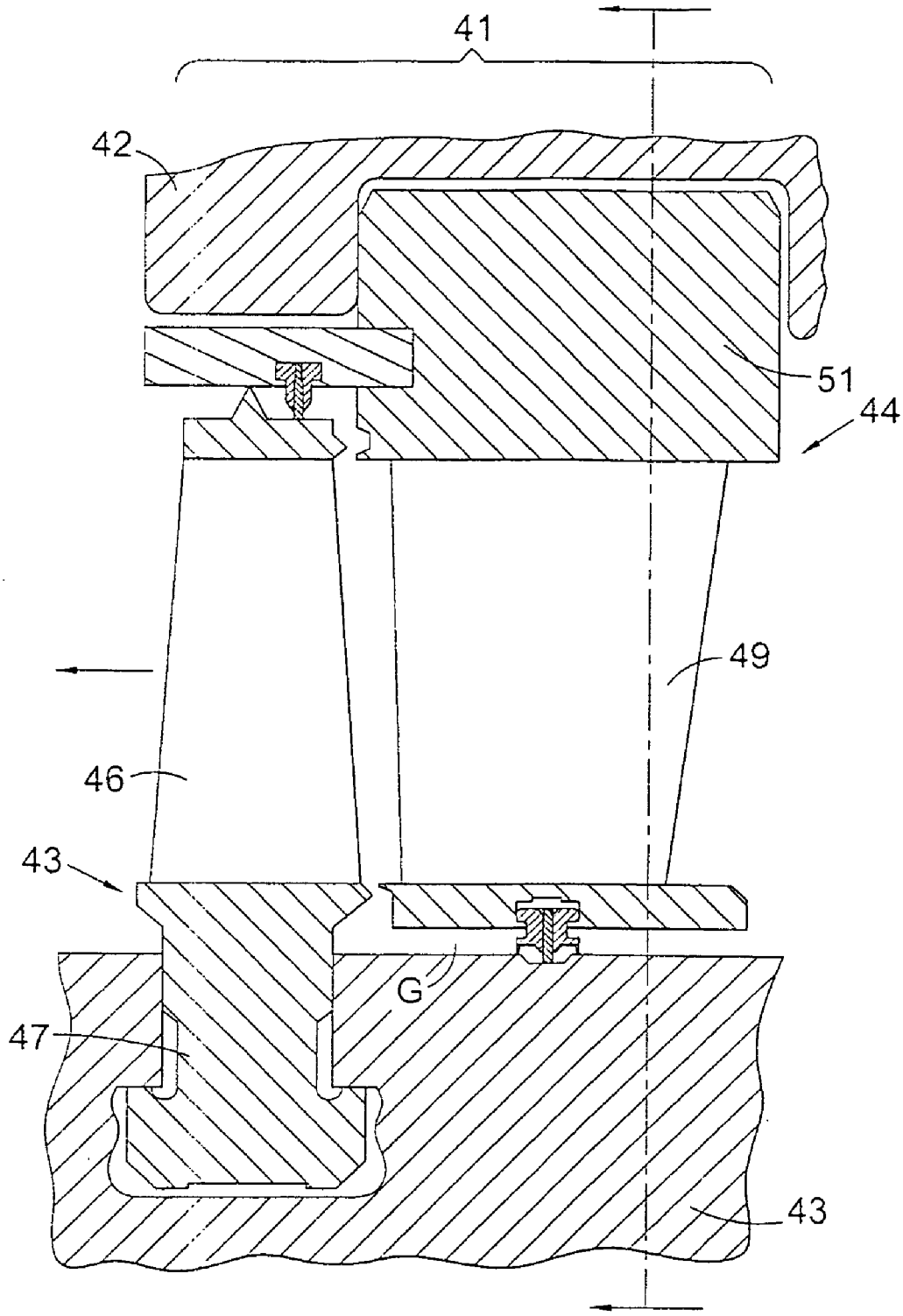
Fig. 1 PRIOR ART
FIG. 1 is a partial axial section through one known type of steam turbine.

As shown in FIG. 1, a turbine stage 41 is one of a plurality of such stages in a steam turbine comprising a turbine casing 42 surrounding a drum type rotor 43. The turbine stage 41 comprises a static blade assembly 44 upstream of an annular row of moving blades 46 having root portions 47 held within a channel-shaped slot 48 in the periphery of the rotor 43. The static blade assembly 44 comprises an annular row of static blades 49 extending between a radially outer static ring 51 and a radially inner static ring 52, the radially inner side of which confronts the periphery of the rotor 43. Both rings 51 and 52 are segmented as necessary for manufacture, assembly and operation of the turbine.

In accordance with this embodiment of the invention, each rotor blade 46 has the configuration shown in FIGS. 2 to 6. The complete blade 46 is shown in perspective view from different angles in FIGS. 2*a*, 2*b* and 2*c*, and its root 47 is shown in enlarged form in FIGS. 2*d*. The optional locking arrangement is shown in 2*e*. The arcuate blade portion 46 is pre-twisted in the sense that the parallelogram-shaped shroud 57 aligns axially with the edges of the root 47 only under torsion.

The root 47 has a generally T-shaped section, which enables it to be twisted into a locking position in the correspondingly T-shaped channel of the rotor or drum. The two substantially parallel surfaces 48*a* and 48*b* of the root, which extend radially and nominally parallel to (or about 30° or 40° to) the axis of the turbine in use, are generally flat. Each face 48*a*, 48*b* is created from a radial plane rotated through an angle about a radial line. Each radial plane and radial line is 'clocked' relative to another by one blade pitch—so the two faces are not completely parallel. However, in accordance with the invention they are provided with raised portions or lands 100*a*, 100*b*. Each land has a rectangular section, so that it has a flat surface. Each land extends the full length of the root in the axial direction.

Figure 2A:
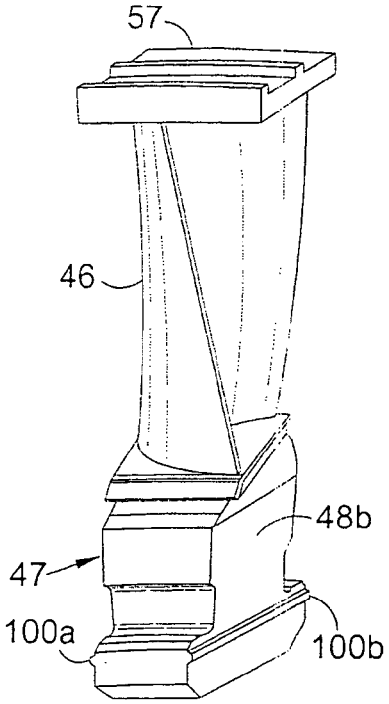
FIGS. 2*a* to 2*e* are perspective views, to different scales, of a turbine blade or part of a turbine blade embodying the invention, FIG. 2*e* showing details of the preferred positive locking device.
Figure 2B:
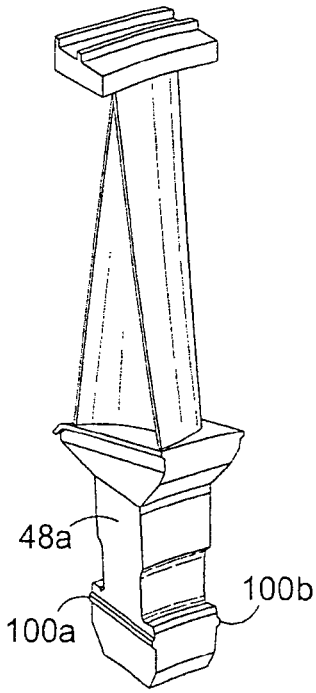
Figure 2C:
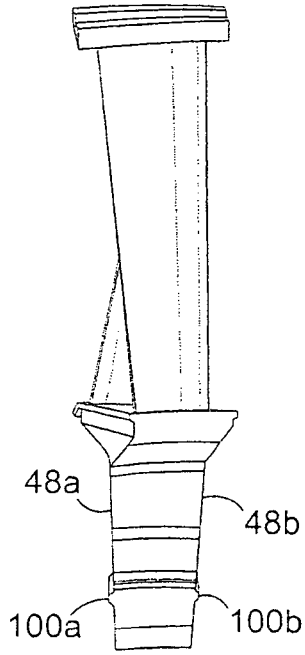
Figure 2D:
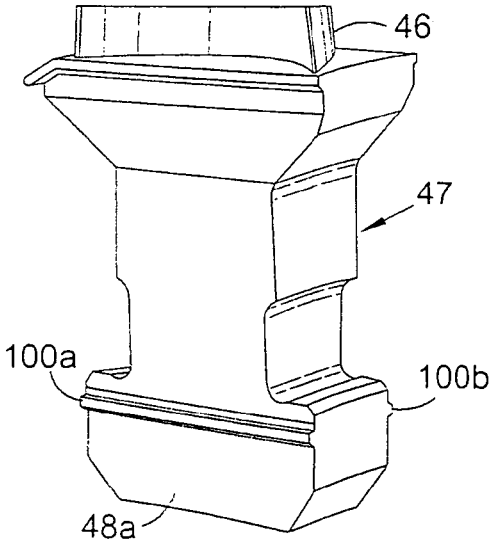
Figure 2E:
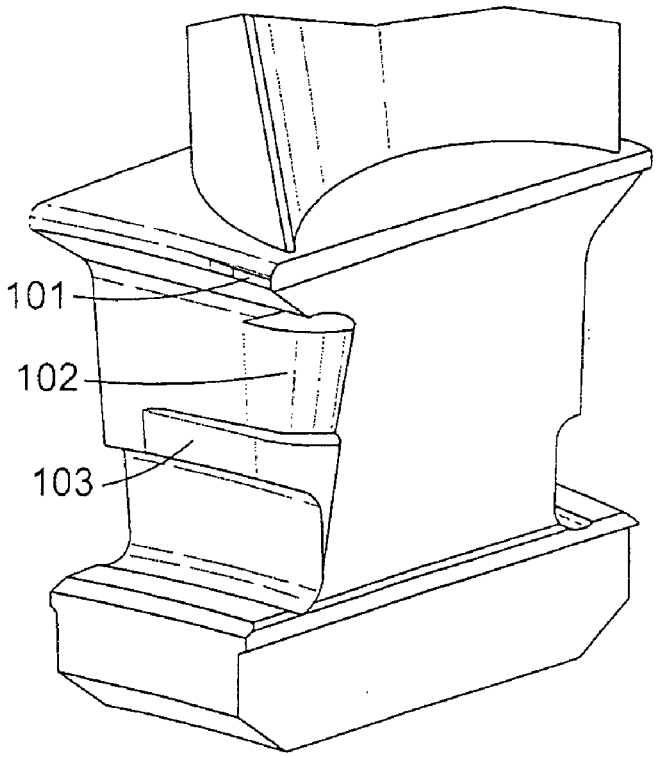

As shown in FIG. 2*e*, the root has a 2 degree flat 101 which allows the blade to rotate and to move in by a distance of 6 mm, in this example.

A radius portion 102 on one surface of the root facilitates main assembly.

Figure 2F:
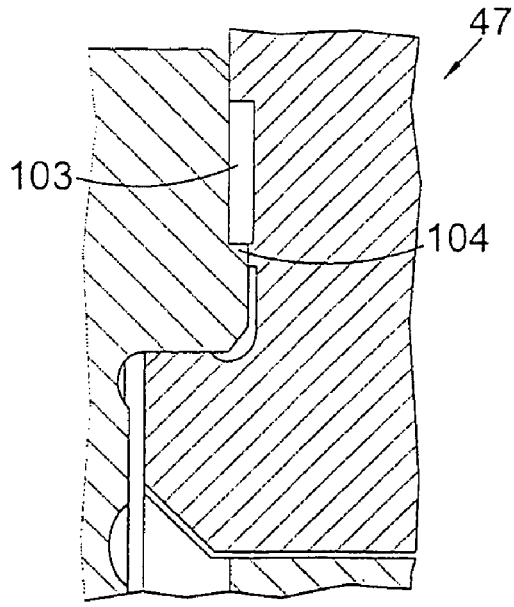
FIG. 2*f* is an enlarged partial section through the turbine blade root and the turbine rotor, showing further details of the positive locking device.

Further down the root, a two degree 0.7 mm land 103 is provided for latching roots, on both sides (one side only being shown in FIG. 2*e*). These clearance flats and radii assist assembly. As shown in FIG. 2*f*, a corresponding land 104 projecting axially from part of the narrow section of the T-shaped channel in the rotor 43, engages the land 103 and the two lands 103, 104 lock together by the engagement of their shoulders, forming perpendicular ledges, when the blade is twisted into its final position. The radially-inward facing ledge on the land 103 locks against the radially-outward facing ledge on the land 104.

This provides a positively locating locking mechanism to locate the blades in their required radially assembled condition. The blades which are staggered radially inwards are prevented from fully rotating around a radial line by the lands 104 formed in the T-section channel of the rotor contacting with the axially facing sides of the T-section roots. The abutment of the two ledges 103, 104 in the final position provides a positive location to prevent the blade moving radially inwards once it has been assembled unless the blade is rotated by a small angle to allow the ledges on the blade and rotor to clear one another.

In the case when this positive locating device 103, 104 is fitted, then the alternate blades must be rotated by a small angle prior to pushing them radially inwards. A small tangential clearance must be created to allow this first blade to be rotated and pushed in. This clearance will be created by pushing all the blades in the wheel hard together, and taking up very small blade to blade clearances which have been built into the design. The clearance required is normally only one or two millimeters.

Figure 3:
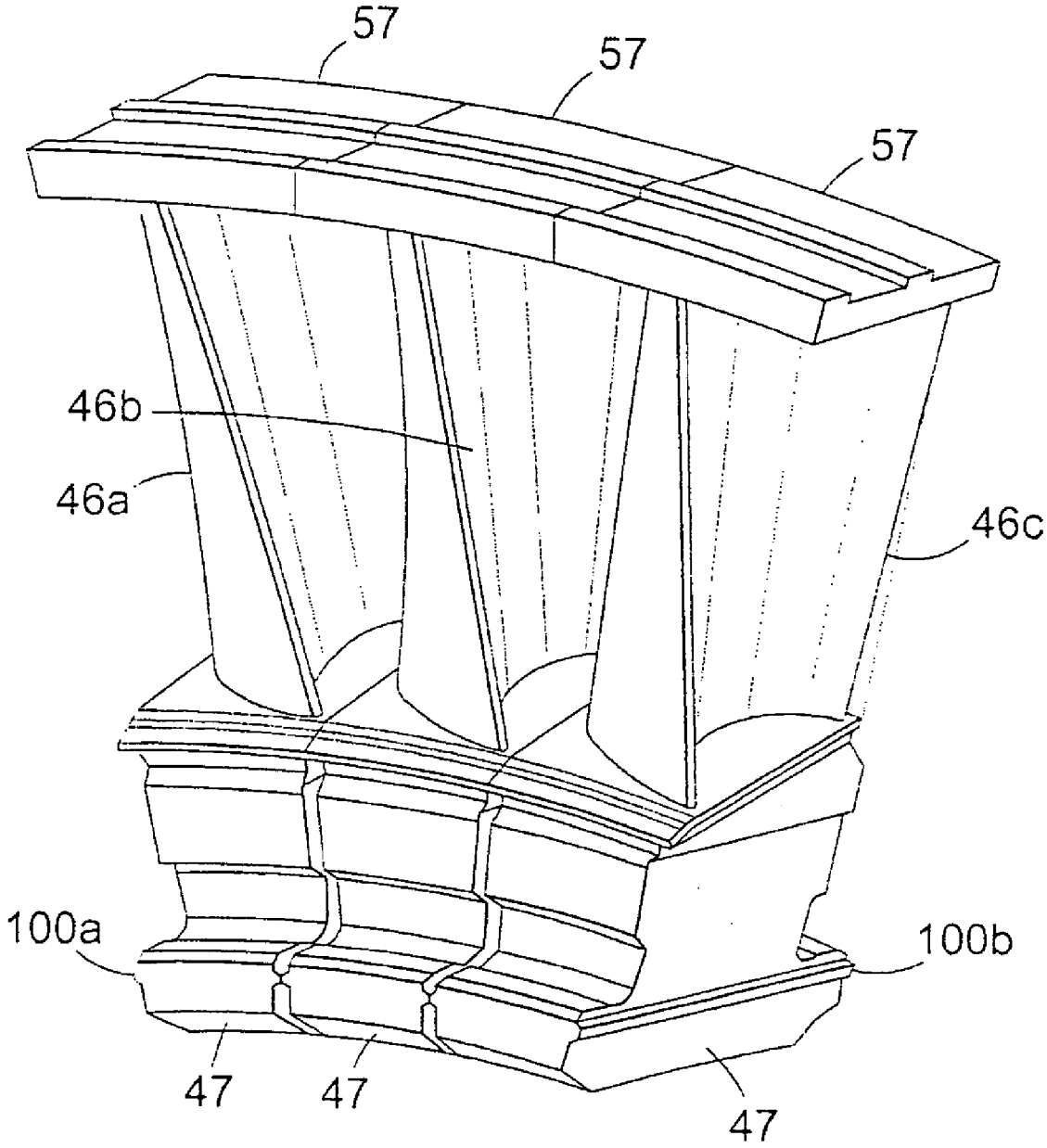
FIG. 3 is a perspective view of three adjacent turbine blades embodying the invention.

Three adjacent blades are shown together in FIG. 3, in their final assembly position, with lands 100*a*, 100*b* opposed and abutting or separated by a very small clearance of a fraction of a millimeter. The axially-extending edges of the shrouds 57 also abut and provide frictional inter-engagement. In this configuration, as previously described, the pre-twist of the blades causes a torsional bias between adjacent shrouds 57 in the configuration shown in FIG. 3. In this position, there is a 3.2 mm gap tangentially between the major flat surfaces of the roots, caused by the thickness of each land 100*a*, 100*b* being 1.6 mm. The width of each land in this example is 2.5 mm.

Figure 4A:
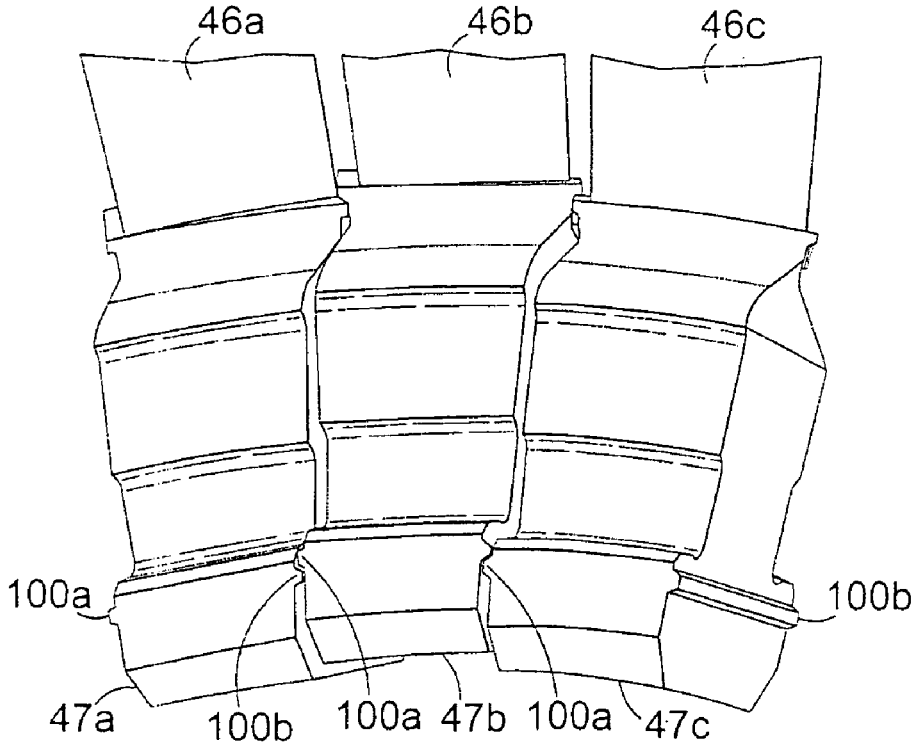
FIGS. 4*a* to 4*c* are perspective views showing parts of three adjacent blade roots embodying the invention and illustrating the way they cooperate.
Figure 4B:
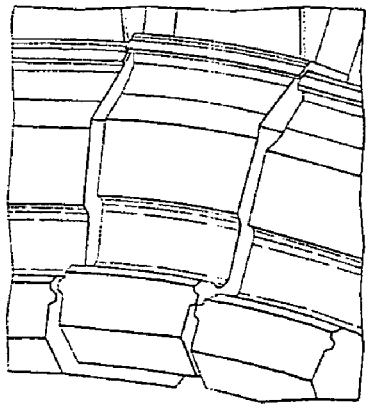
Figure 4C:
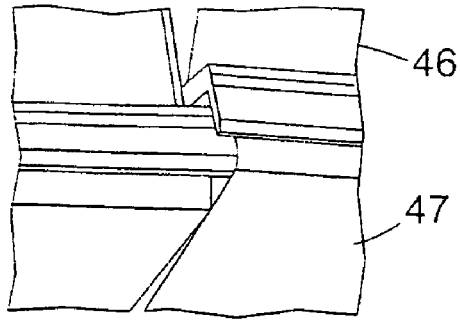

The same blades 46*a*, 46*b* and 46*c* are shown enlarged in FIGS. 4*a* to 4*c*, but this time before assembly has been completed, in a relatively staggered configuration, with the middle blade 46*b* moved radially outwards, and the lands 100*a*, 100*b* staggered. The gaps between the adjacent roots are reduced to just the thickness 1.6 mm of one of the lands. The radial difference in position of the middle blade 46*b* between FIGS. 3 and 4*a*, in this example, is 3 mm. The difference of angular separation between these two configurations is 0.3 degree of arc, although in other examples the range of differences could be between 0.1 degree and 0.5 degree for example.

The radial depth of the channel in the rotor drum has to be great enough to accommodate this differential radial movement, so there must be a gap of at least 3 mm to provide sufficient free play. The gap in this example is 5 mm between the base of the roots in their final assembled position and the base of the channel.

As shown most clearly in FIG. 4*c*, the top portions of the roots of adjacent blades overlap, in the region of the steam inlet. The blades require no shims to hold them in place.

Figure 5:
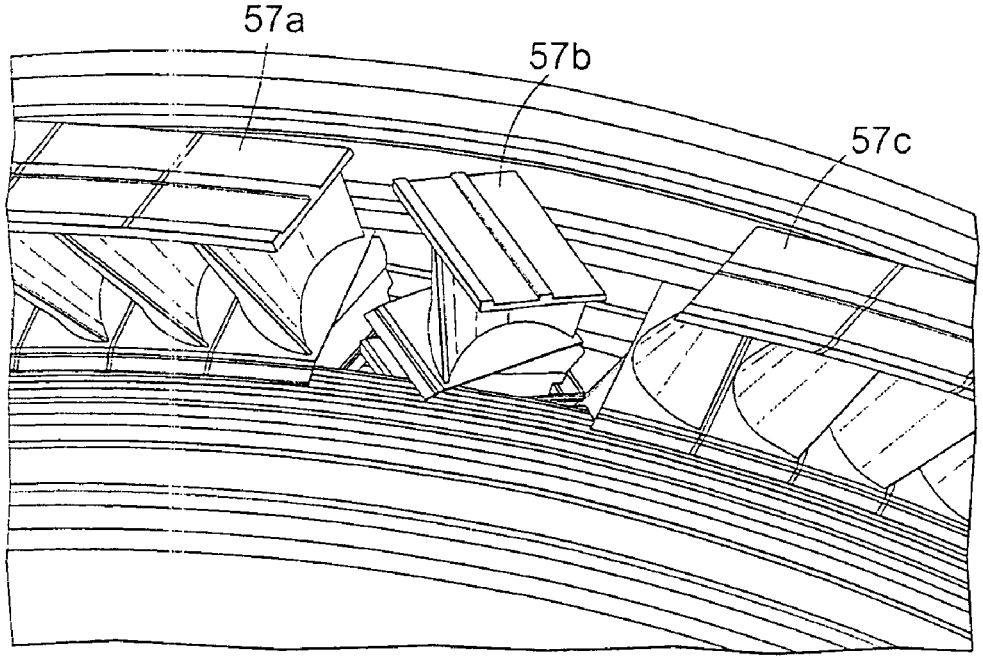
FIG. 5 is a perspective view of part of a turbine rotor at the last stage of assembly of the blades.

The turbine rotor is assembled as follows, with reference in particular to FIGS. 5 and 6.

Successive blades are twisted into engagement in the channel of the rotor, and are pushed into tangential abutment, ensuring that alternate roots are staggered radially, to minimise the gaps, as shown in the FIG. 4 arrangement. FIG. 5 illustrates the stage at which a final gap exists between the penultimate blade 46*a* and the ante-penultimate blade 46*c*, into which the final blade 46*b* is inserted and twisted. The residual gaps between the final blade 46*b* and the other blades are eliminated by pulling alternate blades radially outwards, so that they all adopt the configuration shown in FIG. 3, maximising the gaps between the roots, with the lands 100*a*, 100*b* abutting or facing each other with a small clearance of a fraction of one millimeter. A final two degree twist of each blade secures them all in their final position.

Figure 6:
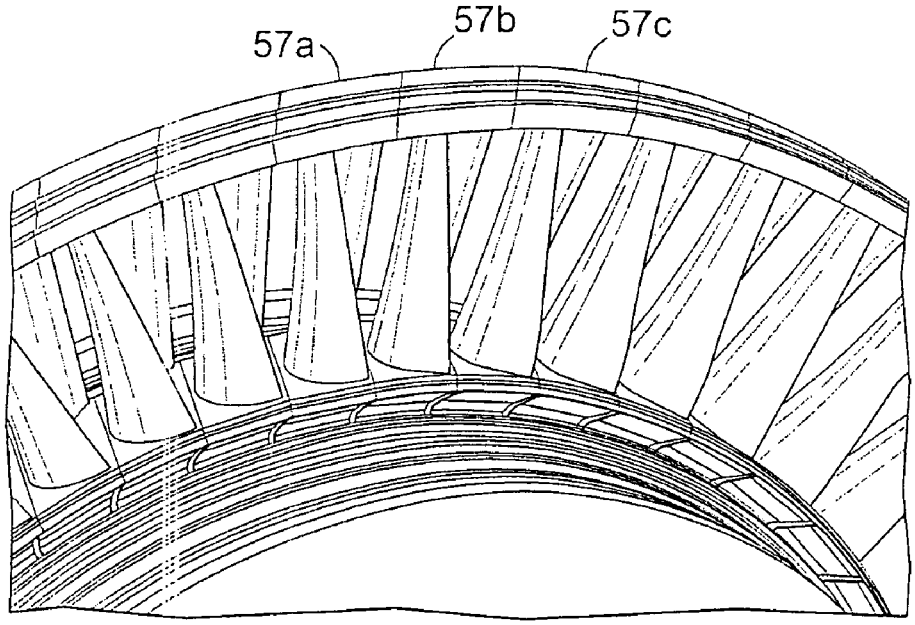
FIG. 6 is a perspective view of part of the assembled turbine rotor using blades according to the invention.

The final assembled configuration is shown in FIG. 6. In this configuration, the shrouds 57*a*, 57*b*, 57*c*, etc. are in contacting engagement along their edges. The blades are held in place while non-rotating by a net radial force produced by the contact forces between abutting shroud portions of adjacent blades resolved onto a radial line through the centre of the blade, and by friction between edges of the shrouds. Once the turbine is rotating, then centrifugal force ensures that the blades maintain their correct position.

The 3.2 mm tangential gap between the two blade roots provides a path for steam to flow from the upstream to the downstream side of each blade. This path can provide a valuable performance benefit by ensuring that steam leaking from the shaft seal upstream of the turbine blade (below the fixed blade) is kept away from the main flow through the blade, a function normally provided by so-called 'steam balance holes'. Alternatively various mechanisms are available for closing this flow path, including a blanking plate.

Disassembly of the turbine blade assembly is performed by reversing the assembly process. Thus alternate blades are pushed in radially, to introduce the staggered configuration and to reduce the gaps between the roots; the roots are then arranged tangentially so as to maximise the gap around one particular blade, which can then be twisted and removed, allowing all the other blades then to follow.

The present invention has been described above purely by way of example, and modifications can be made within the scope of the invention as claimed. The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the claims and drawings, may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

What is claimed is:

1. A turbine assembly comprising a turbine rotor and a ring of turbine blades having blade portions, radially outer shroud portions and radially inner T-section root portions inserted into a corresponding T-section channel in the turbine rotor, the root portions comprising circumferential abutment means for abutment with corresponding abutment means on adjacent root portions, the blades being radially displaceable relative to each other after insertion into the channel such that in an initial assembled position the circumferential abutment means on adjacent root portions are radially staggered but in a final assembled position the circumferential abutment means are in radial alignment.

2. A turbine assembly according to claim 1, wherein the blade portions are pre-twisted so that in the final assembled position radial alignment of the circumferential abutment means and the shroud portions provides a torsional bias which maintains the shroud portions in pressure and frictional contact with their neighbours to resist radial movement of the blades.

3. A turbine assembly according to claim 1, wherein the root portions further comprise radial abutment means for abutment with radial abutment means in the channel of the turbine rotor when the root portions are in the final assembled position.

4. A turbine assembly according to claim 3, wherein the radial abutment means comprise radially inward-facing ledges on the root portions that latch against radially outward-facing ledges on the T-section channel.

5. A turbine assembly according to claim 3, wherein there are small gaps between confronting circumferential abutment means when they are in the final assembled position.

6. A turbine assembly according to claim 1, wherein the circumferential abutment means comprises circumferentially projecting lands on opposed sides of the root portions.

7. A turbine assembly according to claim 6, wherein each land is of generally rectangular configuration.

8. A turbine assembly according to claim 6, wherein each land extends over a full axial extent of the root portion.

9. A turbine assembly according to claim 1, wherein in the final assembled condition there are gaps between confronting faces of neighbouring root portions that are related to a combined thickness of the circumferential abutments of neighbouring root portions.

10. A turbine assembly according to claim 1, wherein the circumferential abutments of each blade have a combined thickness relative to a circumferential width of the blade such that a difference in angular separation between adjacent root portions in the initial and final assembly positions respectively is in the range 0.1 to 0.5 degrees of arc.

11. A turbine assembly according to claim 10, wherein said difference in angular separation is about 0.3 degrees of arc.

12. A turbine assembly comprising a turbine rotor and a ring of turbine blades having blade portions, radially outer shroud portions and radially inner T-section root portions inserted into a corresponding T-section channel in the turbine rotor, the root portions having radial abutment means for abutment with radial abutment means in the channel of the turbine rotor when the root portions are in a final assembled position within the channel in the rotor, the radial abutment means on the root portion and the channel being dimensioned to engage with each other only during a final angularly small rotation of the blade root portion into the final assembled position.

13. A turbine assembly according to claim 12, wherein the radial abutment means on the root portion are dimensioned to engage with the abutment means on the channel during a final two degrees of rotation of the blade root portion into the final assembled position.

14. A turbine assembly according to claim 13, wherein the radial abutment means comprise radially inward-facing ledges on the root portions that latch against radially outward-facing ledges on the T-section channel.

15. A turbine rotor blade configured for use in the turbine assembly of claim 1.

16. A turbine blade having a shroud, a blade portion and a T-section root portion configured to lock into a T-section channel in a turbine rotor adjacent like blades in a ring, the shroud being part-annular and configured with generally the same angle of arc as the root, but the blade portions being pre-twisted so that mutual alignment of the edges of the root and the shroud portion along the axis of the turbine in a final assembled position provides a torsional bias which maintains the shroud in pressure and frictional contact with its neighbours to resist relative radial movement; the surfaces of the root portion being generally flat in two substantially parallel radial planes of the T-section, but having circumferential abutment means projecting from each of those flat surfaces at the same radius, such that a gap comprising an angular separation between adjacent like blades is greater, by an amount related to a combined thickness of the abutment means, when the abutment means are radially aligned in the final assembled position than when the abutment means are radially staggered.

17. A blade according to claim 16, in which each circumferential abutment means comprises a land.

18. A blade according to claim 17, in which the lands are generally rectangular and flat.

19. A blade according to claim 16, in which each land extends the full axial length of the blade root portion.

20. A blade according to claim 16, in which a combined thickness of the circumferential abutment means in relation to a circumferential width of the blade is such that the gap between adjacent like blades changes by between 0.1 degree and 0.5 degree of arc when the blades are moved between the radially aligned and radially staggered conditions.

21. A blade according to claim 20, in which the change in the gap is substantially 0.3 degree of arc.

22. A blade according to claim 16, wherein the root portion includes radial abutment means for abutment with radial abutment means in the channel of the turbine rotor when the root portions are in the final assembled position.

23. A blade according to claim 22, wherein the radial abutment means on the root portion comprises radially inward-facing ledges on opposed sides thereof, and the radial abutment means on the channel of the turbine rotor comprises radially outward-facing ledges corresponding to the radially inward-facing ledges on the root portion.

24. A blade according to claim 22, wherein the circumferential abutment means are dimensioned such that there are small gaps between confronting circumferential abutment means of neighbouring blades when they are in the final assembled position.

25. A turbine rotor assembly comprising a rotor provided with a T-section channel in its periphery and a multiplicity of blades having T-shaped root portions located in the T-section channel, each blade further having a shroud portion and a blade portion, the blade portions being pre-twisted so that mutual alignment of the edges of the root portions and the shroud portions along the axis of the turbine in a final assembled position provides a torsional bias which maintains the shroud portions in pressure and frictional contact with their neighbours to resist relative radial movement; tangentially facing surfaces of the root portions having circumferential abutment means projecting from each said surface at the same radius, such that a gap comprising an angular separation between adjacent blades is greater, by an amount related to a combined thickness of the abutment means, when the abutment means are radially aligned in the final assembled position than when the abutment means are radially staggered in an initial assembled condition.

26. A turbine rotor assembly according to claim 25, the assembly being held in place while non-rotating by a net radial force produced by the contact forces between abutting shroud portions of adjacent blades resolved onto a radial line through the centre of the blade, and by friction between edges of the shrouds, the circumferential abutments of adjacent rotor root portions being radially aligned, with the root portions locked into the T-shaped channel in the rotor in the final assembled condition.

27. A method of assembling a turbine assembly constructed according to claim 1, comprising the steps of: (a) inserting and twisting all but one of the blades into engagement of their root portions in the rotor channel, but with alternate root portions staggered radially such that none of the circumferential abutment means are radially aligned and a gap remains into which the last blade root portion can be inserted, the gap being of greater circumferential extent than the last blade root portion; (b) twisting the last blade into place in the gap to leave a residual gap adjacent the last blade; and (c) lifting alternate blades radially outward to radially align the circumferential abutment means and substantially close the residual gap.

28. A method according to claim 27, wherein after step (c), the blades are further twisted though a small angle into the final assembled position to engage radial abutment means on the root portion with radial abutment means on the channel in the rotor.

29. A method of disassembling a turbine assembly constructed according to claim 1, comprising the steps of: (a) pushing alternate blades radially inward so as to radially stagger them so that the circumferential abutment means are no longer in radial alignment; (b) arranging the blades so as to provide a gap around one of the blades; (c) twisting the said one blade and removing it radially from the assembly; and (d) successively removing further blades.

30. A method according to claim 29, comprising performing the following steps before step (a): (i) selecting a first blade for removal; (ii) pushing all the blades in the rotor hard together to close up small gaps provided between confronting circumferential abutment means of neighbouring blades, thereby to create a circumferential clearance between the selected first blade and a neighbouring blade; (iii) twisting the selected first blade by a small amount to unlatch radial abutments on the blade root portion from radial abutments on the channel in the rotor; and (iv) pushing the selected first blade radially inward; the method further comprising an additional step before each alternate blade is pushed radially inwards, the additional step comprising twisting each said alternate blade by a small amount to unlatch radial abutments on the blade root portion from radial abutments on the channel in the rotor.

* * * * *